US007141005B2

(12) United States Patent
Wu

(10) Patent No.: US 7,141,005 B2
(45) Date of Patent: Nov. 28, 2006

(54) ASSEMBLED FRONT HOUSING OF A TREADMILL

(76) Inventor: Shen Yi Wu, No. 10, Kung Yeh Lane, Feng Cheng Rd., Wu Feng Hsiang, Taichung Hsien (TW)

( * ) Notice: Subject to any disclaimer, the term of this patent is extended or adjusted under 35 U.S.C. 154(b) by 538 days.

(21) Appl. No.: 10/743,914

(22) Filed: Dec. 24, 2003

(65) Prior Publication Data

US 2005/0148439 A1 Jul. 7, 2005

(51) Int. Cl.
*A63B 22/02* (2006.01)

(52) U.S. Cl. ..... 482/54

(58) Field of Classification Search ..... 482/51, 482/54

See application file for complete search history.

(56) References Cited

U.S. PATENT DOCUMENTS 6,113,519 A * 9/2000 Goto ..... 482/54
6,572,512 B1 * 6/2003 Anderson et al. ..... 482/51
6,899,659 B1 * 5/2005 Anderson et al. ..... 482/54
D521,577 S * 5/2006 Wu ..... D21/669

* cited by examiner

*Primary Examiner*—Stephen R. Crow
(74) *Attorney, Agent, or Firm*—Rosenberg, Klein & Lee

(57) ABSTRACT

An assembled front housing of a treadmill includes a panel, a first side casing and a second side casing respectively laterally connected to two opposite sides of the panel for covering a drive device and a lifting device of the treadmill. The first side casing includes a first connecting portion formed thereon and the second side casing includes a second connecting portion formed thereon. The panel includes a third connecting portion and a fourth connecting portion respectively laterally extending from the two opposite sides of the panel and respectively connected to the first connecting portion of the first side casing and the second connecting portion of the second side casing.

6 Claims, 6 Drawing Sheets

ASSEMBLED FRONT HOUSING OF A TREADMILL

BACKGROUND OF THE INVENTION

1. Field of the Invention

The present invention relates to a front housing of a treadmill, and more particularly to an assembled front housing of a treadmill.

2. Description of Related Art

The current treadmill usually is electric driven. A drive device and a lifting device are necessary to the electric treadmill and mounted on the front portion of the treadmill. For protecting the drive device and the lifting device and providing a good looking, a housing is mounted to the front portion of the main frame of the treadmill.

A conventional front housing of a treadmill in accordance with the prior art is a one-piece structure. Consequently, multiple front housings are necessary for corresponding to the treadmills with different models. As a result, multiple molds are necessary for manufacturing the multiple front housing. However, the cave in the mold for manufacturing has a great cross-section that influences on the running melted material. For decreasing the fail rate of the front housing, the conventional front housing for a treadmill is simplified so that the appearance of the front housing is limited.

Furthermore, the mold for manufacturing the front housing of the treadmill is expensive and has a great size. Consequently, the cost of the molds and the space for storing the molds are a heavy load to the manufacturer.

The present invention has arisen to mitigate and/or obviate the disadvantages of the conventional front housing of a treadmill.

SUMMARY OF THE INVENTION

The main objective of the present invention is to provide an improved assembled front housing of a treadmill for reducing the manufacturing cost and the storing cost.

To achieve the objective, the assembled front housing of a treadmill in accordance with the present invention comprises a panel, a first side casing and a second side casing respectively laterally connected to a first side and a second side of the panel for covering a drive device and a lifting device of the treadmill. The first side casing includes a first side wall integrally extending from a first side thereof opposite to the panel. A first front wall integrally extends from the first side casing and is laterally integrally connected to the first side wall. Multiple first apertures are defined in the first side wall for user to easily mounted the first side casing to a main frame of the treadmill. The second side casing includes a second side wall integrally extending from a first side thereof opposite to the panel. A second front wall integrally extends from the second side casing and is laterally integrally connected to the second side wall. Multiple second apertures are defined in the second side wall for user to easily mounted the second side casing to the main frame of the treadmill. The panel includes a first side laterally connected to a second side of the first side casing, a second side laterally connected to a second side of the second side casing and a third front wall integrally extending from the panel. The third front wall has two opposite sides respectively laterally connected to the first front wall of the first side casing and the second front wall of the second side casing.

Further benefits and advantages of the present invention will become apparent after a careful reading of the detailed description with appropriate reference to the accompanying drawings.

DETAILED DESCRIPTION OF THE INVENTION

Figure 1:
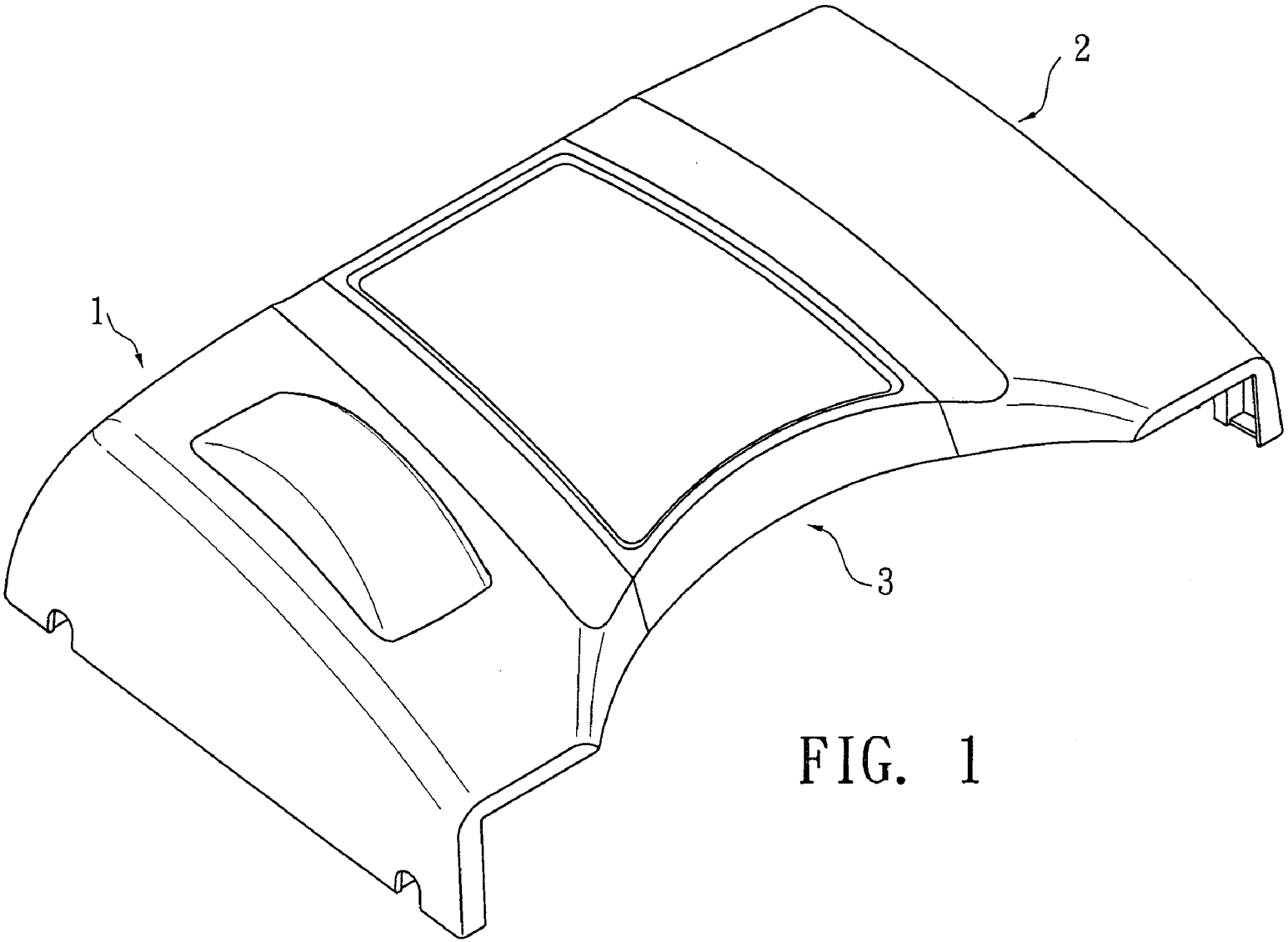
FIG. 1 is a perspective view of an assembled front housing of a treadmill in accordance with the present invention.
Figure 2:
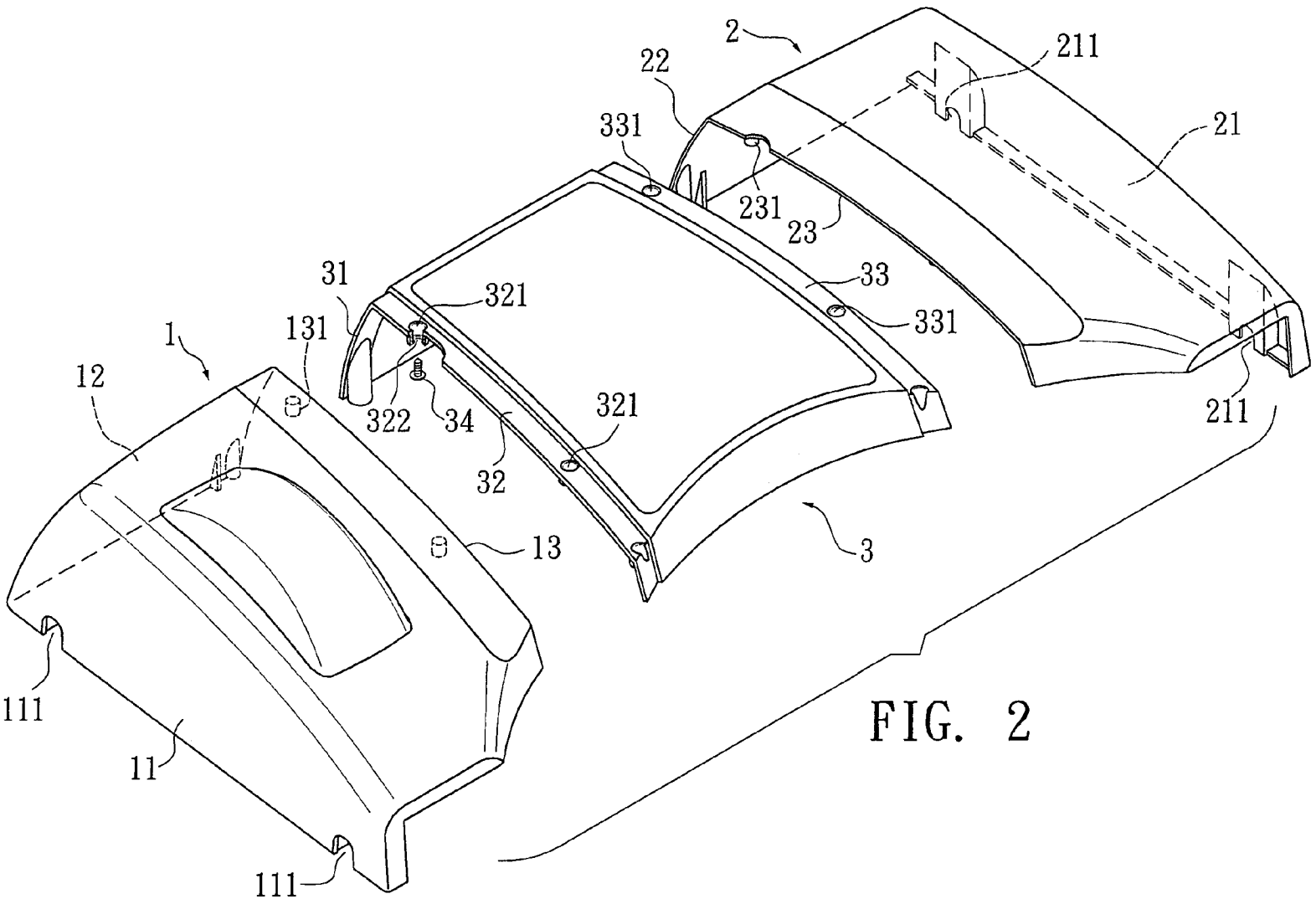
FIG. 2 is an exploded perspective view of the assembled front housing in FIG. 1.
Figure 3:
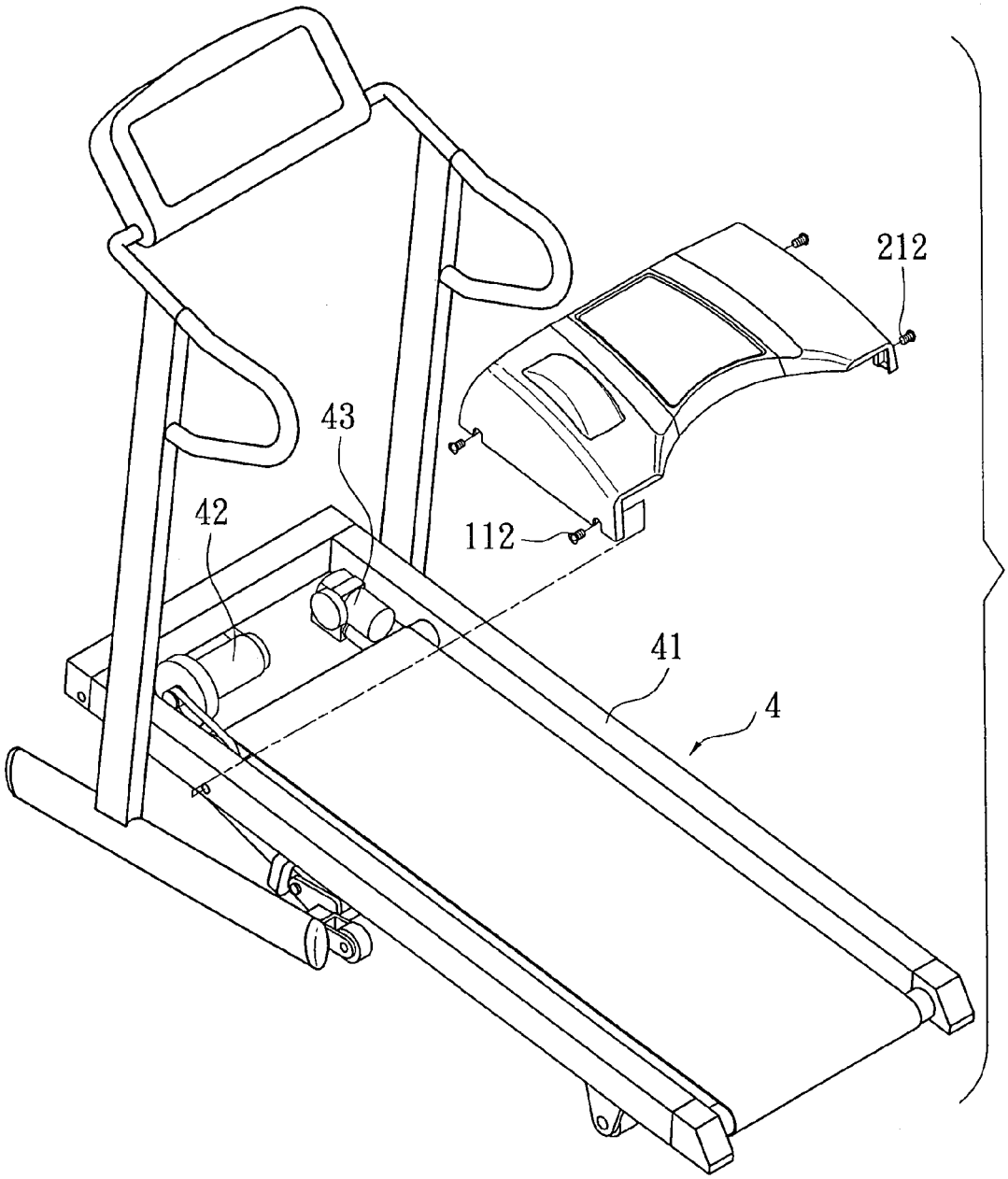
FIG. 3 is a perspective schematic view of the assembled front housing of the present invention.
Figure 4:
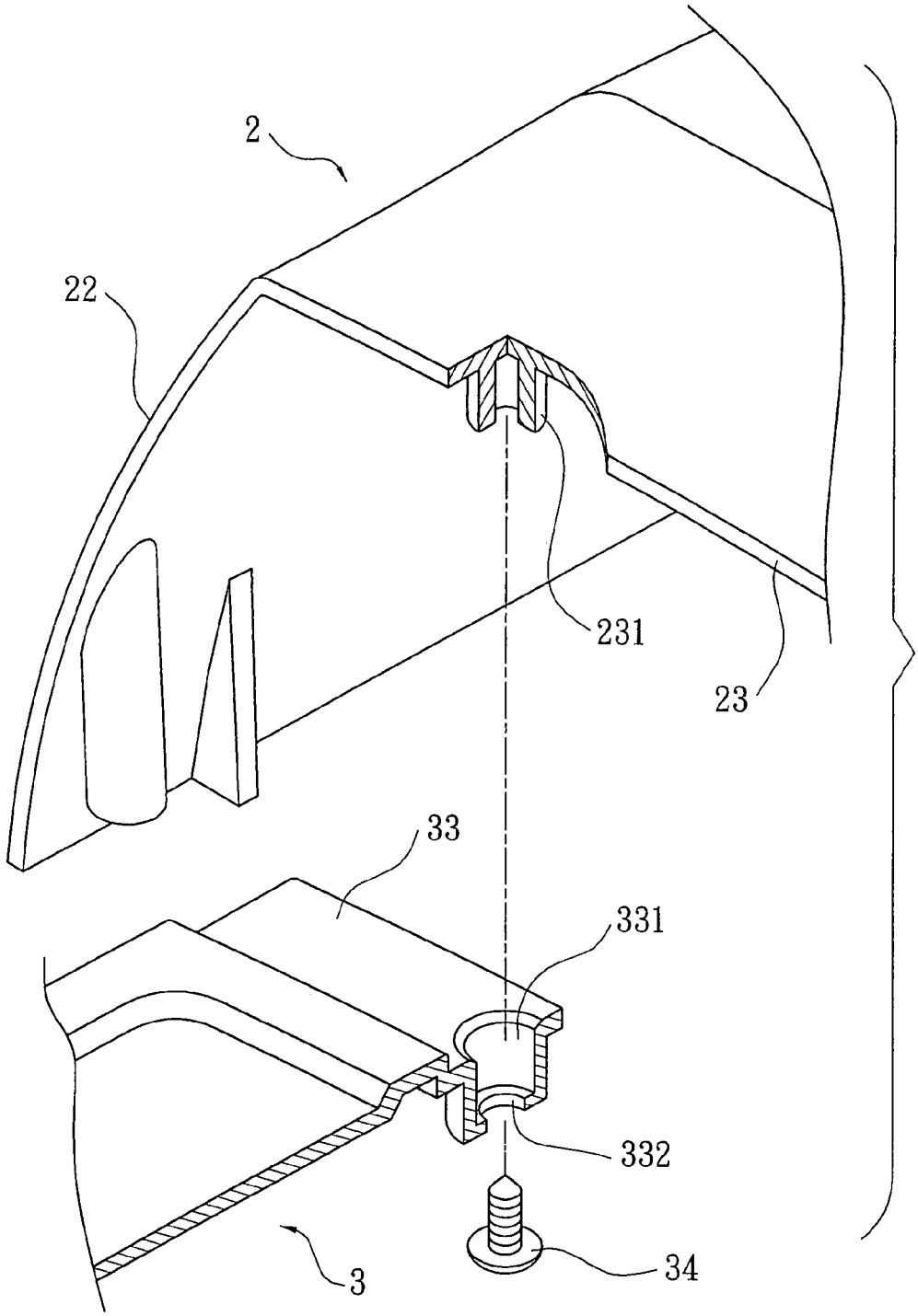
FIG. 4 is a partially perspective view of the assembled front housing in FIG. 1 in partial cross-section.
Figure 5:
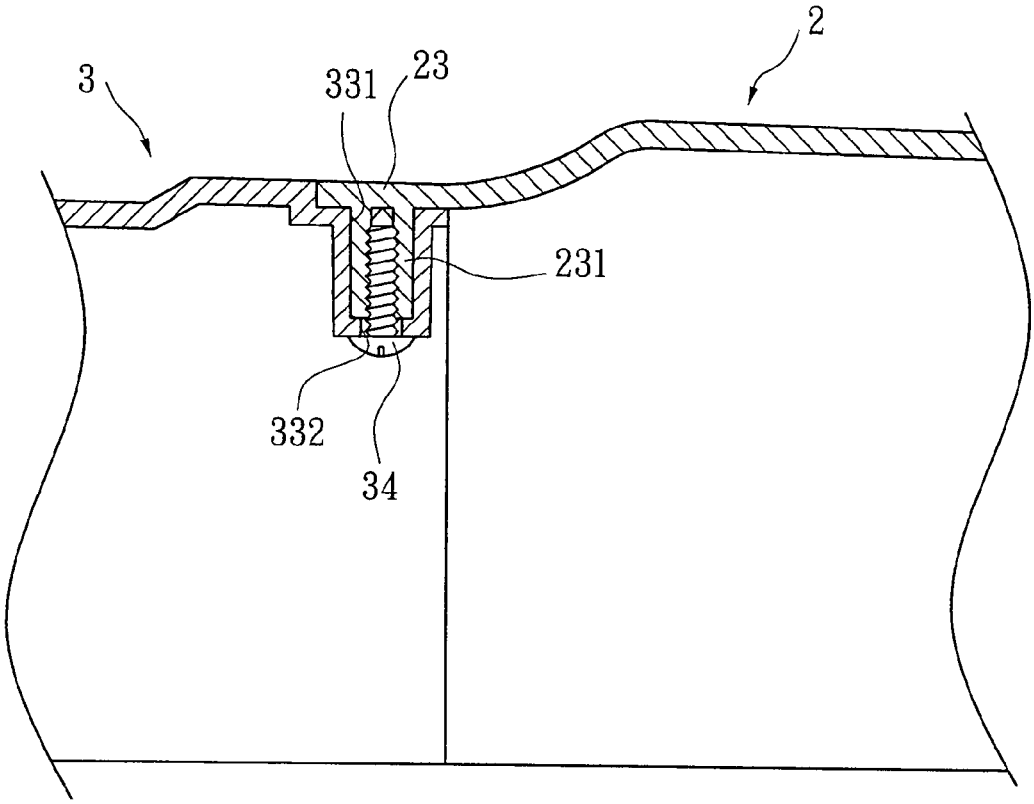
FIG. 5 is a partially cross-sectional view of the assembled housing in FIG. 1.

Referring to the drawings and initially to FIGS. 1–5, an assembled front housing of a treadmill (4) in accordance with the present invention comprises a panel (3). A first side casing (1) and a second side casing (2) respectively laterally connected to a first side and a second side of the panel (3). The first side and the second side of the panel (3) are opposite to each other. The assembled front housing of the present invention is adapted to be mounted to a front portion of a main frame (41) of the treadmill (4) for covering a drive device (42) and a lifting device (43) of the treadmill (4).

The first side casing (1) includes a first side wall (11) integrally extending from a first side thereof opposite to the panel (3) and a second side wall (12) integrally extending from a second side of the first side casing (1) toward a front end of the treadmill (4) and laterally integrally connected to the first side wall (11). The first side wall (11) includes multiple first apertures (111) for the user to easily mount the first side casing (1) to the main frame (41) of the treadmill (4) by multiple first bolts (112). The first side casing (1) includes a first connecting portion (13) formed thereon opposite to the first side wall (11) and corresponding to a first side of the panel (3). The first connecting portion (13) includes multiple first stubs (131) perpendicularly downward extending from a bottom of the first connecting portion (13).

The second side casing (2) symmetrically corresponds to the first side casing (1) relative to the panel (3). The second side casing (2) includes a second side wall (21) integrally extending therefrom, multiple second apertures (211) defined in the second side wall (21) for user to easily mounted to the main frame (41) via multiple second bolts (212), a second front wall (22) integrally extending therefrom and laterally integrally connected to the second side wall (21), and a second connecting portion (23) formed therein for connected to a second side of the panel (3) and having multiple second stubs (231) perpendicularly downward extending from the second connecting portion (23).

The panel (3) includes a third front wall (31) integrally extending therefrom and having two opposite sides respectively laterally connected to the first front wall (12) of the first side casing (1) and the second front wall (22) of the second side casing (2). The panel (3) has a third connecting portion (32) laterally extending from the first side thereof and abutting an inner periphery of the first side casing (1). Multiple first cavities (321) are defined in the third connecting portion (32) of the panel (3). Each first cavity (321) is provided to receive a corresponding one of the multiple first stubs (131). A first through hole (322) is defined in a bottom of each of the multiple first cavities (321) for allowing a first bolt (34) extending through the first through hole (322) and screwed into the corresponding first stub (131) to hold the first side casing (1) in place adjacent to the first side of the panel (3). The panel (3) has a fourth connecting portion (33) laterally extending from the second side thereof and abutting an inner periphery of the second side casing (2). Multiple second cavities (331) are defined in the fourth connecting portion (33). Each second cavity (331) is provided to receive a corresponding one of the multiple second stubs (231). A second through hole (332) is defined in a bottom of each of the multiple second cavities (331) for allowing a third bolt (34) extending through the second through hole (332) and screwed into the corresponding second stub (231) to hold the second side casing (2) in place adjacent to the second side of the panel (3).

As usual, the drive device (42) and the lifting device (43) respectively mounted to two opposite sides of the main frame (41) of the treadmill (4). Consequently, the drive device (42) and the lifting device (43) are respectively covered by the first side casing (1) and the second side casing (2). The shapes of the first side casing (1) and the second casing is directed to the functions of covering so that the first side casing (1) and the second side casing (2) of the present invention can be standardized and the panel (3) can be modified to make the assembled front housing of the present invention be suitable to various treadmills.

Figure 6:
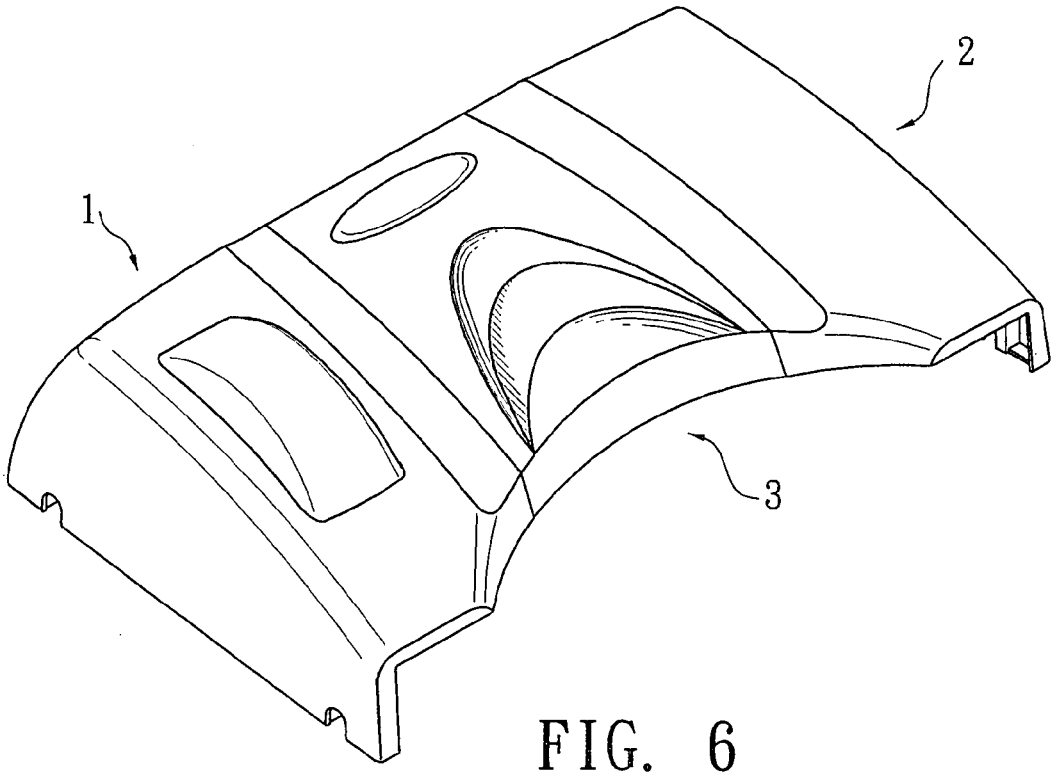
FIG. 6 is a perspective view of a second embodiment of the assembled front housing in accordance with the present invention.
Figure 7:
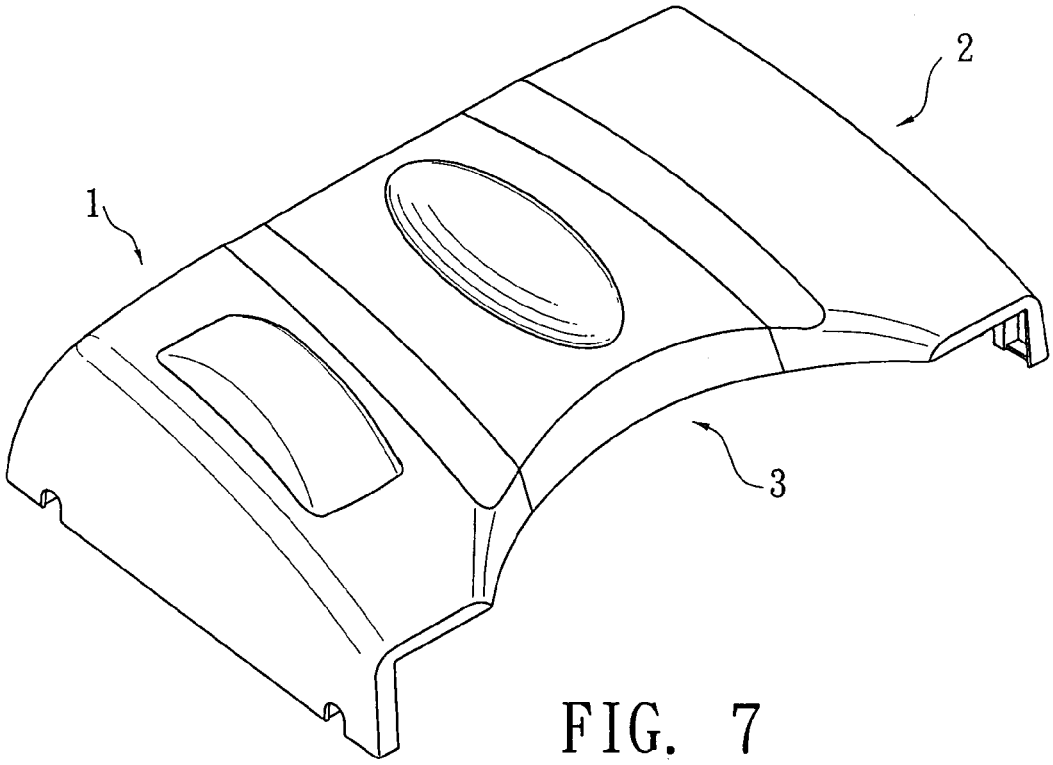
FIG. 7 is a perspective view of a third embodiment of the assembled front housing in accordance with the present invention.

As described above, the assembled front housing in accordance with the present invention is composed of a first side casing (1), a panel (3) and a second side casing (2) so that the volumes of the molds for molding the assembled front housing are smaller than that of the mold for molding the integral conventional front housing of a treadmill. Consequently, the fail rate of molding the front housing of the present invention is reduced and the panel (3) is changeable for a vivid appearance. With reference to FIGS. 6 and 7, the first side casing (1), the second side casing (2) and the panel (3) are respectively formed by different molds so that the colors and the materials of the first side casing (1), the second side casing (2) and the panel (3) can be different from one another for providing a vivid appearance.

The first connecting portion (13) of the first side casing (1), the second connecting portion (23) of the second side casing (2), the third and the fourth connections (32, 33) are designed as linear structures. Furthermore, the trademark can formed on the panel (3) during inject molding so that the front housing in accordance with the present invention can satisfy the corporate identity system (CIS) of the buyer of the manufacturer.

In addition, the first side casing (1) and the second side casing (2) are standardized so that the cost of manufacturing and storing the present invention has been greatly reduced.

Although the invention has been explained in relation to its preferred embodiment, it is to be understood that many other possible modifications and variations can be made without departing from the spirit and scope of the invention as hereinafter claimed.

What is claimed is:

1. An assembled front housing of a treadmill, comprising a panel, a first side casing and a second side casing respectively laterally connected to a first side and a second side of the panel, and adapted to cover a drive device and a lifting device of the treadmill, wherein:

the first side casing includes a first side wall integrally extending from a first side thereof opposite to the panel, a first front wall integrally extending therefrom and laterally integrally connected to the first side wall, and multiple first apertures defined in the first side wall, the multiple first apertures adapted for a user to easily mount the first side casing to a main frame of the treadmill;

the second side casing includes a second side wall integrally extending from a first side thereof opposite to the panel, a second front wall integrally extending therefrom and laterally integrally connected to the second side wall, and multiple second apertures defined in the second side wall, the multiple second apertures adapted for a user to easily mount the second side casing to the main frame of the treadmill; and the panel includes a first side laterally connected to a second side of the first side casing, a second side laterally connected to a second side of the second side casing and a third front wall integrally extending from the panel, the third front wall having two opposite sides respectively laterally connected to the first front wall of the first side casing and the second front wall of the second side casing.

2. The assembled front housing of a treadmill as claimed in claim 1, wherein:

the first side casing includes a first connecting portion formed on a second side thereof;

the second side casing includes a second connecting portion formed on a second side thereof; and the panel includes a third connecting portion laterally extending from the first side thereof and fourth connecting portion extending from the second side thereof, the third connecting portion abutting an inner periphery of the first side casing and connected to the first connecting portion of the first side casing, and the fourth connecting portion abutting an inner periphery of the second side casing and connected to the second connecting portion of the second side casing.

3. The assembled front housing of a treadmill as claimed in claim 2, wherein the first side casing, the second side casing and the panel are respectively formed by different molds so that the colors and the materials of the first side casing, the second side casing and the panel can be different from one another for providing a vivid appearance.

4. The assembled front housing of a treadmill as claimed in claim 2, wherein the first connecting portion of the first side casing, the second connecting portion, the third connecting portion and the fourth connecting portion of the panel are designed as linear structures.

5. The assembled front housing of a treadmill as claimed in claim 2, wherein:

the panel includes multiple first cavities defined in the third connecting portion and multiple second cavities defined in the fourth connecting portion;

the first side casing includes multiple first stubs perpendicularly downward extending from a bottom of the first connecting portion, each first stub securely received in a corresponding one of the multiple first cavities in the third connecting portion of the panel for connecting the first side casing to the panel; and the second side casing includes multiple second stubs perpendicularly downward extending from a bottom of the second connecting portion, each second stub securely received in a corresponding one of the multiple second cavities in the fourth connecting portion of the panel for connecting the second side casing to the panel.

6. The assembled front housing as claimed in claim 5 further comprising multiple bolts each extending through a bottom of each of the first and second cavities and screwed into a corresponding one of the multiple first stubs the multiple second stubs to combine the first side casing and the second side casing with the panel.

* * * * *